United States Patent [19]

Geiser

[11] Patent Number: 4,836,528

[45] Date of Patent: Jun. 6, 1989

[54] APPARATUS FOR MANIPULATING SHEET-LIKE COMMODITIES IN GATHERING MACHINES

[75] Inventor: Peter Geiser, Matzingen, Switzerland

[73] Assignee: Grapha-Holding AG, Hergiswil, Switzerland

[21] Appl. No.: 100,088

[22] Filed: Sep. 23, 1987

[30] Foreign Application Priority Data

Sep. 24, 1986 [CH] Switzerland ..... 3830/86

[51] Int. Cl.[4] ..... B65H 7/12

[52] U.S. Cl. ..... 271/263; 271/277; 270/56; 340/675

[58] Field of Search ..... 271/275–277, 271/265, 258, 259, 262, 263; 209/603, 604; 192/127; 340/675; 270/54–56

[56] References Cited

U.S. PATENT DOCUMENTS

| | | | |
|---|---|---|---|
| 3,199,862 | 8/1965 | Muller . | |
| 3,521,880 | 7/1970 | Shebanow et al. | 271/265 |
| 4,078,784 | 3/1978 | Miaskoff et al. | 271/263 |
| 4,085,927 | 4/1978 | Muller . | |
| 4,127,266 | 11/1978 | Williams | 271/277 |
| 4,358,100 | 11/1982 | Muller . | |
| 4,498,240 | 2/1985 | Van Dijk | 340/675 |
| 4,527,793 | 7/1985 | Bottcher et al. | 209/603 |
| 4,550,252 | 10/1985 | Tee | 271/263 |

*Primary Examiner*—H. Grant Skaggs

*Attorney, Agent, or Firm*—Peter K. Kontler

[57] ABSTRACT

Successive sheets are drawn from a magazine by a gripper which is movably mounted on a drum-shaped rotary conveyor and serves to transfer successive sheets into a gathering machine. The position of the gripper with reference to the conveyor is indicative of the thickness of the sheet or sheets which are transported from the magazine, and such position is ascertained by a monitoring device in cooperation with an input element which is movable with the gripper. The input element can constitute a soft iron core which extends into a coil of an oscillatory circuit constituting the monitoring device, a plate which extends between the plates of a capacitor forming part of the monitoring device, or an arm for a disc bearing encoded information which is monitored by a photoelectronic transducer. The monitoring device transmits signals to a circuit which is adjacent the path of movement of the gripper and includes the transducer or a winding cooperating with a winding of the oscillatory circuit. Signals from the winding or from the transducer are processed by an evaluating circuit and are used to regulate the speed of the conveyor.

9 Claims, 2 Drawing Sheets

APPARATUS FOR MANIPULATING SHEET-LIKE COMMODITIES IN GATHERING MACHINES

CROSS-REFERENCE TO RELATED CASE

The apparatus of the present invention is similar to apparatus which are disclosed in the commonly owned copending patent application Ser. No. 100,125 filed Sept. 23, 1987 by Hans Peter Duss for Measuring Apparatus.

BACKGROUND OF THE INVENTION

The invention relates to improvements in apparatus for manipulating commodities in gathering machines for paper sheets and the like. More particularly, the invention relates to improvements in apparatus which can be used to monitor condition and/or the presence or absence of sheets in certain sections of machines or production lines which are used for bookbinding, for accumulation of sheets into pamphlets or brochures, and for similar purposes.

It is known to monitor successive sheets which are drawn from a magazine and are transferred onto a sword or onto another part of a gathering machine wherein the sheets (e.g., signatures) are accumulated into larger groups preparatory to sewing, stapling or another mode of connecting the assembled sheets or groups of sheets to each other. As a rule, the apparatus are provided with means for monitoring the thickness of sheets which are engaged by the gripper or grippers on the conveyor which serves to draw successive sheets from a magazine or from another suitable source. The density monitoring device normally includes a roller or a like part which rides over the sheet or sheets advancing from the magazine to the next station. The extent of displacement of the roller from its normal or anticipated position is indicative of the presence or absence of a sheet or of the presence of two or more sheets or groups of sheets in lieu of one. Signals which are generated in response to movement of the roller from its normal or anticipated position are used to arrest the conveyor or the entire machine in which the conveyor is in use.

The just described monitoring apparatus operates satisfactorily as long as the speed of the conveyor for the gripper or grippers remains below a certain maximum permissible value. If the speed is increased, the roller must be biased against the conveyor and the sheet or sheets thereon with a very large force so that the roller is likely to deface and/or otherwise damage the sheets. Another drawback of such monitoring apparatus is that the cost of properly mounting the roller with reference to the gripper or grippers and vice versa is very high because the mounting must be such that the gripper or grippers and the roller cannot perform any stray movements (such as vibratory movements) relative to each other. Stray movements would distort the signals which are generated as a result of monitoring of the position of the roller with reference to the conveyor for the gripper or grippers.

OBJECTS AND SUMMARY OF THE INVENTION

An object of the invention is to provide a novel and improved apparatus for manipulating sheets and like commodities in gathering or similar machines in such a way that the speed at which the commodities are being transported does not influence the quality of treatment.

Another object of the invention is to provide a lightweight apparatus which can monitor the parameters of transported commodities without resorting to rollers and like parts which could affect the appearance and/or other desirable characteristics of the conveyed commodities.

A further object of the invention is to provide a novel and improved apparatus for ascertaining the thickness of sheet-like commodities during transport of commodities from a source to a gathering or other processing station.

An additional object of the invention is to provide the apparatus with novel and improved means for transmitting signals to the unit or units which can influence the transport of commodities in the event of a malfunction.

A further object of the invention is to provide a relatively simple and compact apparatus which can properly monitor the parameters of sheet-like commodities while the commodities are on their way from a source to a gathering or other station at a speed which can greatly exceed the maximum permissible speed of transport of such commodities in machines utilizing conventional density monitoring apparatus.

Still another object of the invention is to provide a novel and improved method of monitoring and regulating the transport of sheet-like commodities in gathering and like machines.

An additional object of the invention is to provide novel and improved means for effecting stoppage of conveyor means for sheet-like commodities on the way from a magazine to a spreading or opening station.

The improved apparatus can be used for manipulation of sheet-like commodities, e.g., to deliver folded sheets from a magazine to a gathering conveyor. The apparatus comprises a source of commodities (such as a magazine which can serve to store stacked paper sheets or signatures), a conveyor (e.g., a cylindrical drum-shaped conveyor) including transfer means movable along an endless path which has a first portion where the transfer means should normally accept commodities from a source and a second portion where the transfer means should normally release accepted commodities, input means cooperating with the transfer means and being movable with reference to the conveyor between a plurality of positions depending on the parameters of commodities (such parameters can include the dimensions of commodities, particularly the thickness of individual, folded or grouped paper sheets), monitoring means provided on the conveyor and serving to generate signals which denote the positions of the input means, means for evaluating the signals, and means for transmitting analog or digital signals from the monitoring means to the evaluating means including signal receiving means adjacent the path of movement of the monitoring means with the conveyor and connected to the evaluating means.

The input means can be provided on (and can form an integral part of) the transfer means, and the conveyor preferably further comprises a support (such as a hollow cylinder or a set of discs) for the transfer means. the transfer means is movable with reference to the support between a plurality of positions depending on the dimensions (particularly the thickness) of commodities which are accepted by the transfer means (the thickness will be zero if the transfer means fails to receive a commodity in the first position of its endless path, and the position of the input means is then indicative of the absence of a commodity between the first and second portions of the path).

The receiving means can comprise trigger means which is out of contact with the monitoring means, i.e., such trigger means can transmit to the evaluating means an appropriate signal when it is being approached by the moving monitoring means.

The monitoring means can include an oscillatory circuit, and the impedance of such circuit is variable as a function of changes in the position of the input means, i.e., as a function of the parameters of commodities which are being transported by the transfer means. The circuit can include a coil and the input means can include a core which is movable with reference to the coil. The circuit can further include a first winding and the signal receiving means can include a second winding which is adjacent the path of movement of the first winding. If the conveyor includes a support in the form of a cylinder or a disc, the two windings are or can be adjacent the peripheral surface of such support, i.e., the first winding is adjacent the peripheral surface and orbits in response to rotation of the support, and the second winding is stationary and is adjacent the path of movement of the first winding. Such apparatus can further include at least one exciter winding which is adjacent the path of movement of the first winding.

Alternatively, the monitoring means can include a carrier of encoded information, and the receiving means then includes means for reading selected information off the carrier, depending upon the position of the carrier with reference to the conveyor. For example, the carrier can constitute or include a disc which is mounted on and is moveable with the transfer means relative to the support of the conveyor, and the information on such disc can be in the binary code. The reading means can include light conductor means having a first portion adjacent the path of movement of the disc and a second portion adjacent an optoelectronic transducer which receives optical signals from the disc via conductor means and transmits electric signals to the evaluating means.

The evaluating means can include means for influencing the speed of the conveyor, e.g., for arresting the conveyor in the absence of a commodity between the first and second portions of the endless path at a time when the transfer means should normally advance a commodity from a source to the second portion of the endless path. For example, the evaluating means can include a microprocessor.

The transfer means can include a gripper, and the conveyor can include means for movably (e.g., pivotably) mounting the gripper on the support of the conveyor.

The novel features which are considerd as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
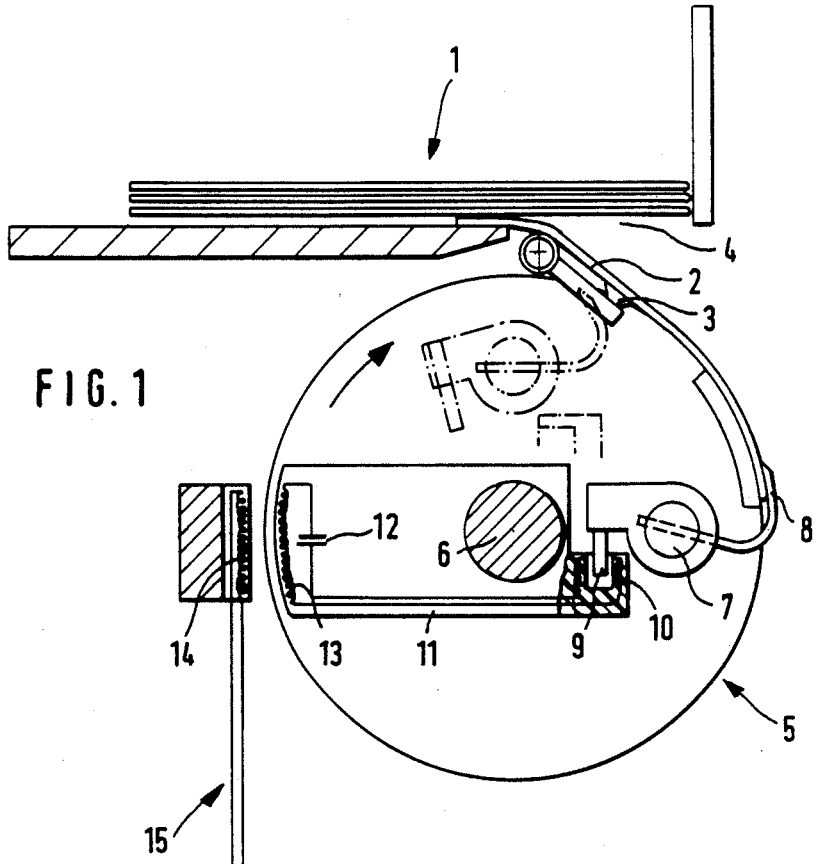
FIG. 1 is a schematic partly elevational and partly sectional view of an apparatus which embodies one form of the invention and wherein the means for monitoring the position of the input means includes as oscillatory circuit whose inductance can be varied by the input means.

FIG. 1 shows an apparatus which embodies one form of the invention and serves to manipulate sheets 2 which are drawn individually from a source 1 wherein they form a stack of superimposed sheets. The bottom part of the matgazine 1 has an opening 4 which enables a pivotable suction head 3 to deflect downwardly the rightmost portion of the lowermost sheet 2 of the stack and to maintain the downwardly deflected portion in a position of readiness adjacent a first portion of an endless circular path defined by a rotary drum-shaped conveyor 5 having a transfer element 8 in the form of an arcuate gripper eccentrically mounted on a disc- or drum-shaped support 5*a* of the conveyor 5. The conveyor 5 may be of the type as described and shown in commonly owned U.S. Pat. Nos. 3,199,862, 4,085,927 and 4,358,100 to which reference may be had, if necessary. Each sheet 2 in the magazine 1 comprises two halves which are folded over each other so that the fold line 2*a* is adjacent the right-hand sidewall of the magazine. The conveyor 5 is driven by a horizontal shaft 6 so as to rotate in a clockwise direction (arrow A) and to orbit the transfer element or gripper 8 along its endless path a first portion of which is adjacent the opening 4 of the magazine 1 and a second portion of which, where the gripper 8 is caused to release the sheet 2, can be located for example at the four, five or six o'clock position of the support 5*a*. The means for movably mounting the gripper 8 on the support 5*a* of the conveyor 5 comprises a pivot member 7 whose axis is parallel to the axis of the shaft 6. The interior of the conveyor 5 confines one or more suitably configurated cams cooperating with follower means (not shown) of the gripper 8 or a linkage serving to pivot the gripper with reference to the support during predetermined stages of each revolution of the support 5*a* so as to ensure that the gripper 8 engages the downwardly flexed portion of the lowermost sheet 2 in the magazine 1 and thereupon extracts such sheet from the magazine prior to releasing the sheet into the range of two so-called opening conveyors which are normally provided in a gathering machine to open up successive folded sheets and to release the opened sheets for descent onto a so-called sword whereon the sheets ride to a stapling or other station in a bookbinding, pamphlet making or like machine.

The gripper 8 constitutes one arm of a two-armed lever which is fulcrumed in the support 5*a*at 7 and whose other arm constitutes or includes an input element in the form of a soft iron core 9 extending into the coil 10 of an oscillatory circuit 11 constituting a means for monitoring the position of the input element 9 and gripper 8, i.e., the thickness of the commodity which is being held by the radially outermost portion of the gripper 8 on its way from the first toward the second portion of the endless path. For example, the angle between the first and second portions of the endless path for the gripper 8 can be between 120° and 270°. It is important to ensure that the second portion of the path be sufficiently remote from the first portion so that the gripper 8 can completely extract the lower most sheet 2 of the stack in the magazine 1 in good time for the suction head 3 to flex downwardly the rightmost portion of the next lowermost sheet of the stack before the gripper 8 reenters the first portion.

The extent to which the input element 9 penetrates into the coil 10 of the oscillatory circuit 11 is indicative of the thickness of the sheet or sheets 2 which are held by the gripper 8. If the thickness is zero, i.e. if the gripper has failed to receive or properly extract a sheet 2 from the magazine 12, the corresponding position of the input element 9 entails the generation of a signal which indicates that the gripper 8 does not advance a sheet to the second portion of its endless path. The circuit 11 further comprises a capacitor 12 and a winding 13 which is adjacent the peripheral surface of the support 5*a* and orbits past a stationary winding 14 forming the signal receiving part of a signal transmitting circuit 15 connected with the first unit 16 of an evaluating circuit 17 which further includes units 18 and 19. The circuits 11 and 15 together constitute a capacitance-inductance (L-C) oscillator which transmits, during certain stages of each revolution of the support 5*a*, to the evaluating circuit 17 signals which denote the position of the input element 9 with reference to the support 5*a* and are thus indicative of certain parameters of commodities which are being pulled by the gripper 8, namely of the number of sheets 2 which are being pulled by the gripper, of the absence of a sheet and/or of the thickness of a signal sheet.

The signal transmitting circuit 15 includes or is connectable to an energy source (e.g., in the unit 16). The inductance of the circuit 11 determines the intensity and/or other characteristics of signals which the circuit 15 transmits to the evaluating circuit 17.

When the winding 13 of the oscillatory circuit 11 is adjacent the winding 14 of the circuit 15, the two windings can be said to form a transformer which transmits signals to the unit 16 of the evaluating circuit 17. It can also be said that the winding 14 constitutes the trigger 14 of the signal transmitting circuit 15 and that the function of such trigger is to generate a signal when it is approached by the orbiting winding 13 but without being actually contacted by any part of the oscillatory circuit 11. To this end, the winding 14 is also closely or immediately adjacent the peripheral surface of the rotating support 5*a*. The winding 14 further serves as a means for energizing the circuit 11 once during each revolution of the support 5*a* and for thereupon transmitting the thus generated signal from the circuit 11 to the circuit 17 so as to denote the momentary position of the input element 9 with reference to the support 5*a*.

Figure 1A:
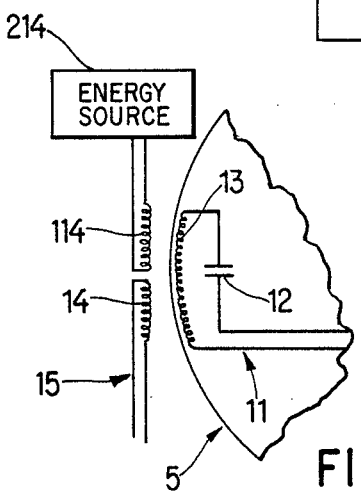
FIG. 1*a* is a fragmentary plan view of a modified apparatus wherein the signal transmitting means need not serve to energize the oscillatory circuit on the conveyor for the transfer means.

As shown in FIG. 1*a*, the apparatus of FIG. 1 can be modified by providing at least one additional winding 114 which is adjacent the winding 14 and is in circuit with an energy source 214. The winding 114 serves to intermittently energize the cirucit 11, and the winding 14 then serves exclusively as a means for transmitting signals from the winding 13 to the evaluating circuit 17.

The units 16 and 18 of the evaluating circuit 17 process the signals which are received from the winding 13 via circuit 15, and the unit 19 can serve as a means for regulating the operation of a prime mover (e.g., an electic motor, not shown) which drives the shaft 6 and hence the conveyor 5. For example, a signal from the unit 19 will be used to arrest the shaft 6 when the signal which is generated as a function of the position of the input element 9 with reference to the support 5*a* indicates that the gripper 8 does not engage a sheet 2 or that the thickness of the commoditiy (e.g., two or three sheets 2) which is being pulled by the gripper 8 is excessive. By the same token, the position of the input element 9 with reference to the support 5*a* can be indicative of the absence of a sheet or of the presence of two sheets even tough the gripper 8 engages and entrains a signal sheet but such signal sheet is defective (e.g., it is too thin or too thick). In other words, the improved apparatus exhibits a high degree of versatility by being able to generate appropriate signals in response to detection of satisfactory operation as well as in response to detection of unsatisfactory operation which is attributable to any one of a plurality of different parameters of treated commodities.

When the gripper 8 has engaged and advances a signal sheet 2 of satisfactory thickness, the signal which is generated as a result of movement of the input element 9 to a corresponding position with reference to the winding 10 (i.e., the impedance of the circuit 11) is such that the evaluating circuit 17 does not cause any change in the speed of the shaft 6 and support 5*a*. However, if the orbiting gripper 8 fails to entrain a sheet 2 in the region of the suction head 3, or if the gripper entrains an unsatisfactory sheet or entrains two or more sheets, the signal which is generated by the circuit 11 and is transmitted to the evaluating circuit 17 is such that the unit 19 arrests the motor for the shaft 6 so that the conveyor 5 comes to a halt and the person in charge is in a position to remedy the situation, e.g., by ensuring that the gripper 8 will be capable of entraining a single sheet 2 during the next pass along the first portion of its endless path or that the gripper will be relieved of excessive sheets and can proceed to transport individual sheets from the first to the second portion of its path during each revolution of the support 5*a*.

Figure 2:
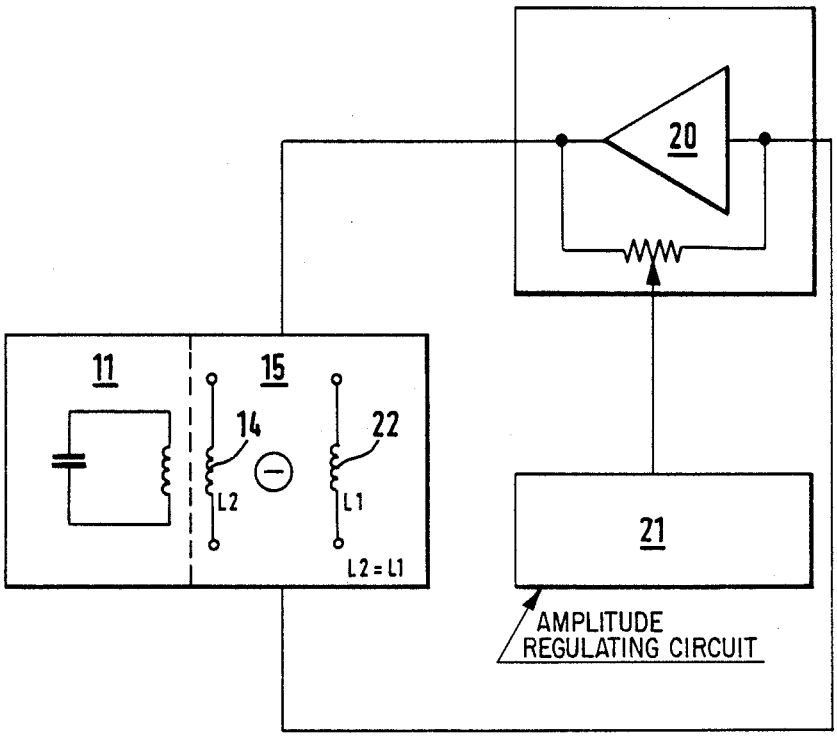
FIG. 2 is a diagram showing certain elements of the evaluating and oscillatory circuits and of the signal transmitting means in the apparatus of FIG. 1.

FIG. 2 shows one presently preferred construction of the evaluating circuit 17. The unit 16 comprises a variable-amplitude amplifier 20 which is adjustable by an amplitude regulating circuit 21. The unit 16 further includes a compensating winding 22 having an inductance L1 which matches the inductance L2 of the winding 14 in the signal transmitting citcuit 15. The difference between the impedances of the coil 10 and winding 22 is proportional to the impendance of the oscillatory circuit 11.

The unit 18 of the evaluating circuit 17 includes a frequency counter, and the unit 19 can include a comparator, particularly a microprocessor, which transmits a signal to influence the speed of the conveyor 5 when the signal from the frequency counter in 18 deviates from a reference signal or from a range of acceptable reference signals. The exact details of the evaluating circuit 17 forms no part of the present invention.

Figure 3:
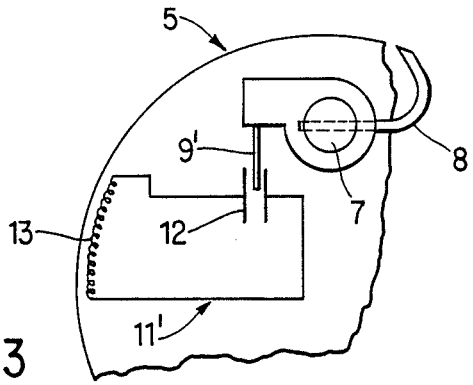
FIG. 3 is a fragmentary schematic elevational view of a third apparatus employing a simplified oscillatory circuit.

FIG. 3 shows a portion of a third apparatus wherein the monitoring circuit 11 of FIG. 1 is replaced with a simplified circuit 11' and in which the input element 9 of FIG. 1 is replaced with a plate-like input element 9' in the space between the plates of the capacitor 12. The position of the input element 9' with reference to the plates of the capacitor 12 is a function of the position of the gripper 8 with reference to the peripheral surface of the support 5*a* (not shown in FIG. 3), i.e., a function of the dimensions of the commodity (if any) which is being advanced by the gripper 8 toward and into the second portion of its path. Thus, the capacity of the capacitor 12 varies as a function of the angular position of the lever including the gripper 8, and such capacity is ascertained by the signal transmitting circuit 15 (not shown in FIG. 3) to transmit appropriate signals to the evaluating circuit.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating sheet-like commodities, comprising a source of commodities; a conveyor including transfer means movable along an endless path having a first portion where said transfer means is arranged to accept commodities from the source and a second portion where the transfer means is arranged to release accepted commodities; input means cooperating with said transfer means and movable with reference to the conveyor between a plurality of positions depending on the parameters of commodities; monitoring means provided on said conveyor and arranged to generate signals denoting the positions of said input means, said monitoring means including an oscillatory circuit and the impedance of said circuit being variable as a function of changes of the position of said input means, said circuit including a first winding; means for evaluating said signals; and means for transmitting signals from said monitoring means to said evaluating means, including signal receiving means adjacent said path and connected with said evaluating means, said signal receiving means including trigger means out of contact with said monitoring means and said trigger means comprising a second winding adjacent the path of movement of said first winding with said conveyor.

2. The apparatus of claim 1, wherein said input means is provided on said transfer means and said conveyor further includes a support for said transfer means, said transfer means being movable with reference to said support between a plurality of positions depending on the dimensions of commodities which are accepted by said transfer means.

3. The apparatus of claim 1, wherein said circuit includes a coil and said input means includes a core which is movable with reference to said coil.

4. The apparatus of claim 1, wherein said conveyor includes a support having a peripheral surface and said windings are adjacent said peripheral surface.

5. The apparatus of claim 1, further comprising at least one exciter winding adjacent the path of movement of said first winding with said conveyor.

6. The apparatus of claim 1, wherein said evaluating means includes means for influencing the speed of said conveyor.

7. The apparatus of claim 1, wherein said evaluating means includes a microprocessor.

8. The apparatus of claim 1, wherein said transfer means includes a gripper and said conveyor further includes a support and means for movably mounting said gripper on said support.

9. The apparatus of claim 1, wherein said source comprises a magazine for a supply of stacked sheets.

* * * * *